United States Patent [19]

Schöler

[11] 3,952,788

[45] Apr. 27, 1976

[54] PLEATED PULL-UP CURTAIN

[75] Inventor: Alfred Schöler, Wuppertal, Germany

[73] Assignee: Vorwerk & Sohn, Textil- und Gummiwerke, Wuppertal-Barmen, Germany

[22] Filed: Apr. 2, 1975

[21] Appl. No.: 564,295

[30] Foreign Application Priority Data

Apr. 3, 1974 Germany ..... 7411620[U]

[52] U.S. Cl. ..... 160/84 R; 160/348

[51] Int. Cl.[2] ..... A47H 13/14

[58] Field of Search ..... 160/84 R, 344, 348

[56] References Cited

UNITED STATES PATENTS

| | | | |
|---|---|---|---|
| 2,884,055 | 4/1959 | Scholer | 160/348 |
| 3,001,579 | 9/1961 | Van Doren | 160/344 |
| 3,369,589 | 2/1968 | Benkert, Jr. | 160/84 R |
| 3,371,700 | 3/1968 | Romano | 160/84 R |
| 3,777,800 | 12/1973 | Susoev | 160/84 R |

FOREIGN PATENTS OR APPLICATIONS

| | | | |
|---|---|---|---|
| 7,242,509 | 8/1973 | Germany | |
| 2,012,363 | 10/1971 | Germany | 160/344 |
| 1,953,273 | 5/1971 | Germany | 160/344 |
| 1,190,614 | 4/1965 | Germany | 160/348 |
| 1,239,824 | 5/1967 | Germany | 160/348 |

*Primary Examiner*—Roy D. Frazier
*Assistant Examiner*—William E. Lyddane
*Attorney, Agent, or Firm*—Holman & Stern

[57] ABSTRACT

A pleated curtain comprising a supporting tape attached to the upper edge on the back side of the curtain, a hanger means, and a plurality of tapes, affixed vertically on the curtain is disclosed. The tapes are divided into alternatingly reinforced and unreinforced segments with cord-guiding loops affixed at the level of each second pleat fold line. Pull cords, guided by the loops and hanger means, are attached to the bottom portion of the curtain. When operated simultaneously, the pull cords evenly raise the curtain and thereby place it into pleats which extend horizontally across the width of the curtain.

6 Claims, 3 Drawing Figures

PLEATED PULL-UP CURTAIN

BACKGROUND OF THE INVENTION

This invention relates to curtains, more specifically, to pleated pull-up curtains.

Known in the prior art is a pleated pull-up curtain having a supporting tape attached at its upper edge of the reverse side, with hooks being fastened to said supporting tape and serving as elements for carrying and guiding the pull cords. The hooks are inserted into prior art curtain rods. Tapes are fastened spaced apart in the longitudinal direction of the curtain and have on the plane of the fold line intermittent reinforcing means. Cord-guiding loops are provided on the tapes through which are guided the pull cords in the vertical and horizontal directions in such a manner that the curtain, under simultaneous operation of all the pull cords, is pulled upwards evenly and is thereby placed into pleats which extend horizontally over the width of the curtain.

In prior art pleated pull-up curtains, for example, those disclosed in the German Utility Pat. No. 7,242,509, the reinforcing means are always interrupted at those points where the fold-line is intended to be formed so that the folds of the curtain are always placed into the same fold-lines during the upwards pulling of the curtain. The disadvantage connected with this type of pleated curtain consists in that the pleats which develop during the upwards pulling of the curtain in a bellows-like fashion form a relatively voluminous pleat-pillow when the curtain is raised.

SUMMARY AND OBJECT OF THE INVENTION

It is an object of the present invention to reduce the voluminousness of the pleat-pillow formed when the curtain is raised. This object is accomplished in the instant invention by providing the tape with zones which are alternately reinforced and not reinforced, wherein the length of the zones is limited by the fold-line of the pleats, and the cord-carrying loops are incorporated at the level of each second fold-line.

A pleat-pillow formed in this fashion is much smaller than a pleat-pillow of a prior art pleated curtain. Additionally, the loop-tape of the instant improvement can be manufactured of a less expensive material and in a more economical manufacturing process, without thereby, as proven in practice, having to resign to a less precise formation of pleats.

The reinforced zones may be formed in a known manner by means of small reinforcing plates which are adapted to the length and width of the respective reinforced zone, and are inserted into pockets which are correspondingly worked into the tape. As a base product for this purpose, a hollow-band of the type described in the German Utility Pat. No. 7,242,509 may be used. The reinforced zones may also be formed by means of reinforcing the tape itself, for example, by using tighter woven or knitted areas for the reinforced zones in contrast to the zones which are not to be reinforced, or by forming an additional binding at the zone to be reinforced during the process of manufacturing the tape. In addition, it is also possible that the reinforced zones may be produced by means of weaving or knitting the zone with multifilament or monofilament threads thicker and/or stiffer than those used for the unreinforced zones.

BRIEF DESCRIPTION OF THE DRAWINGS

The instant improvement is explained in greater detail by the embodiments shown in the drawings, wherein.

DETAILED DESCRIPTION OF SOME PREFERRED EMBODIMENTS

Figures 1, 2, 3:
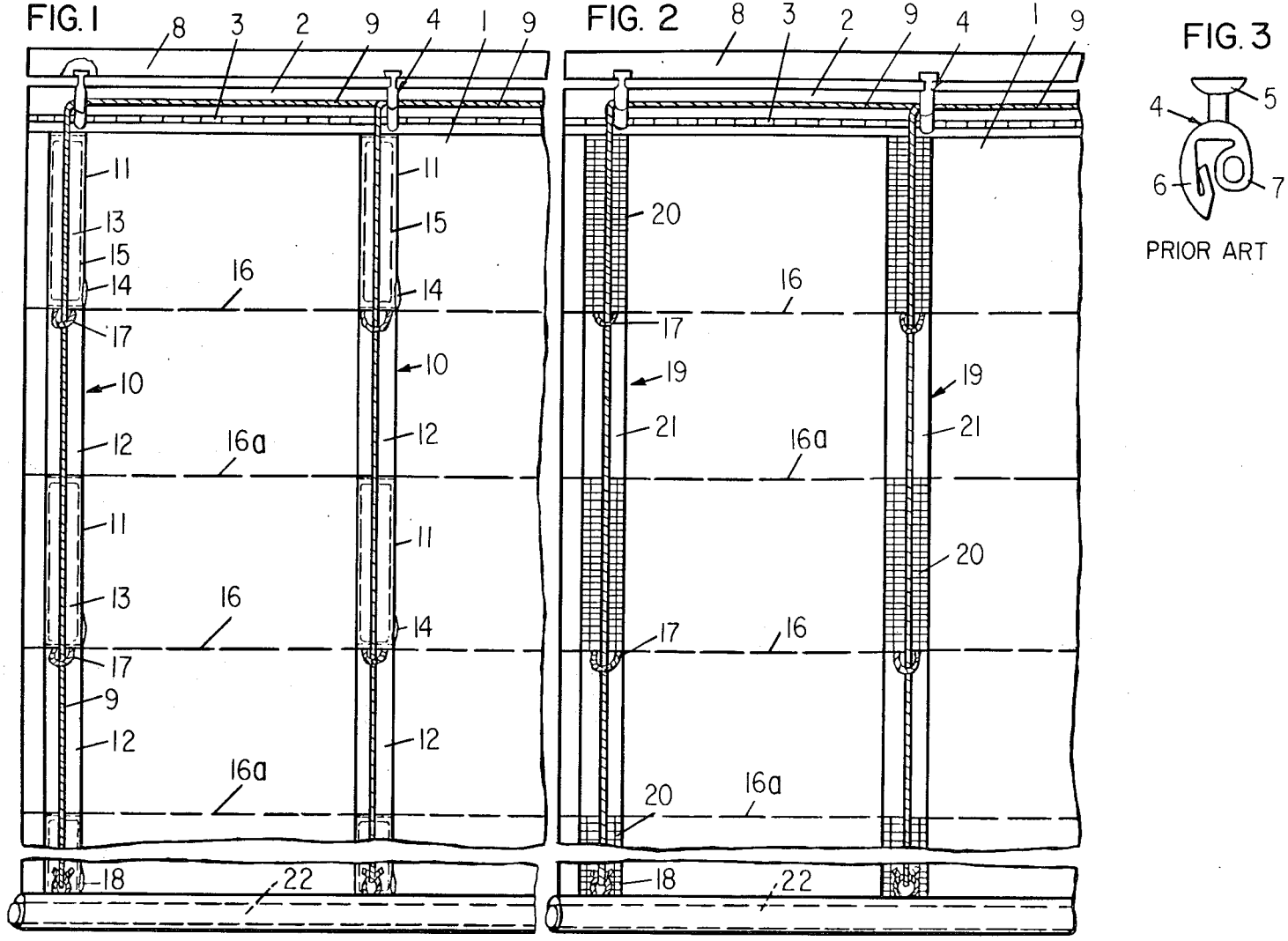
FIG. 3 PRIOR ART
FIGS. 1 and 2 illustrate the backside of a folding curtain according to the instant improvements, having various types of reinforced zones.
FIG. 3 shows a prior art hanger-means necessary for attaching the pleated curtain onto a prior art curtain glide-rod.

In FIGS. 1 and 2, a curtain 1 is provided at its upper end with a prior art support tape 2 into which are integrated hanger-loops 3 which are continuously arranged in longitudinal direction for the purpose of fastening the hangers 4. The hanger 4 (FIG. 3) in addition of being provided with the prior art glide-head 5, by means of which said hanger or hook is guided into a corresponding glide-rail 8 for curtains, has a side-portion with a hook 6 for hooking into the loops 3, as well as a side-portion which is provided with a ring 7 for guiding the pull cord 9.

Tapes 10 are sewn onto the curtain 1 parallel to each other and in a longitudinal direction of the curtain 1, according to FIG. 1, and are provided with alternating reinforced zones 11 and zones 12 which are not reinforced, and which run in longitudinal direction. The reinforced zones 11 are produced in the tape 10 according to FIG. 1 by means of small reinforcing plates 13 comprising a synthetic material. The plates 13 are inserted through openings 14 of pockets 15 which have been worked into the tape. The reinforced zones 11 end or begin close to the fold-line 16 or **16*a* so that the line, along which the curtain fabric is placed into pleats, always forms the limitation of the zones which are reinforced or not reinforced. Guide loops 17 are provided on each second fold-line, namely on fold-line 16, through which the pull cord 9 is guided. The pull cord 9 is fastened to the lowermost guide loop 18, for example, by means of a knot. The pockets 15 can also be obtained by using a tape 10 comprising a hollow band in which the pockets 15** are formed by cross-sectional stitching.

According to FIG. 2, the curtain 1 is provided with tapes 19 which are attached in accordance with the tapes 10 of FIG. 1, and which are provided with zones which are alternately reinforced 20 and not reinforced 21, as well as having loops 17 for guiding the pull cord 9. Herein, the reinforced zones 20 are formed by a denser weaving or knitting of the tape. The reinforced zones may also be obtained by weaving or knitting with multifilament or monofilament threads which are thicker and/or stiffer in contrast to the threads used for the zone 21 which is not reinforced. In case of FIG. 1, as well as FIG. 2, a weight-rod 22 is inserted into a folded pleat at the bottom of the curtain for the purpose of stiffening the curtain and producing an even pleat-formation.

If the pull cords 9 are simultaneously pulled, the curtain will fold upwards always along the fold line **16*a* in bellows-like fashion due to the reinforcements 11 or 20 which terminate closely below the fold-line 16*a*, while the curtain is retained on the fold-lines 16 by means of the loops 17**.

What is claimed is:

1. A pleated pull-up curtain having horizontal pleats when in a pulled-up position, said pleats defining pleat fold lines, said curtain having a width, an upper part, a back side, a bottom portion, and a longitudinal direction extending from the upper part to the bottom portion, comprising: a supporting tape attached to said upper part of said curtain on said back side; hangers being attached to said supporting tape, serving as carrying and cord-guiding elements, and being guided in curtain rails; tapes fastened in a spaced apart fashion having a longitudinal direction and running in said longitudinal direction of said curtain, said tapes being provided with intermittent, alternatingly reinforced and unreinforced zones having a length and running in said longitudinal direction of said tape, said length of said zones being determined by said pleat fold lines; cord-guiding loops worked into said tapes at the level of each second pleat fold line; and pull-cords being fastened to said bottom portion of said curtain and guided in vertical and horizontal pull directions so that under simultaneous activation of all pull-cords, said curtain is evenly pulled upwards and thereby placed into said horizontal pleats over the width of said curtain.

2. The pleated pull-up curtain according to claim 1, wherein the zones which are reinforced are formed by means of small reinforcing plates which are adapted to the length and width of the reinforced zone, and which are inserted into pockets which are worked into the tape.

3. The pleated pull-up curtain according to claim 1, wherein the zones which are reinforced, in contrast to the zones which are unreinforced, are formed by means of a denser weaving or knitting of the tape.

4. The pleated pull-up curtain according to claim 1, wherein the zones which are reinforced are obtained by means of weaving or knitting the tape with multifilament or monofilament threads which are thicker than those used for the zones which are unreinforced.

5. The pleated pull-up curtain according to claim 1, wherein the zones which are reinforced, in contrast to the zones which are unreinforced, are formed by means of an additional binding during manufacture of the tape.

6. The pleated pull-up curtain according to claim 1, wherein the zones which are reinforced are obtained by means of weaving or knitting the tape with multifilament or monofilament threads which are stiffer than those used for the zones which are unreinforced.

* * * * *